US006184770B1

(12) United States Patent
Nakamura et al.

(10) Patent No.: US 6,184,770 B1
(45) Date of Patent: Feb. 6, 2001

(54) MONOLITHIC VARISTOR

(75) Inventors: Kazutaka Nakamura; Kazuhiro Kaneko, both of Shiga-ken (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/287,870

(22) Filed: Apr. 7, 1999

(30) Foreign Application Priority Data

Apr. 7, 1998 (JP) ..... 10-112738

(51) Int. Cl.[7] ..... H01C 7/10; H01C 7/13

(52) U.S. Cl. ..... 338/21; 338/20; 338/224; 29/610.1

(58) Field of Search ..... 338/21, 20, 100, 338/224, 223, 312, 313, 328, 331, 333

(56) References Cited

U.S. PATENT DOCUMENTS 5,231,370 * 7/1993 Arnold, Jr. et al. ..... 338/21
5,234,641 * 8/1993 Rutt ..... 264/61
5,269,972 * 12/1993 Arnold, Jr. et al. ..... 252/519
5,569,495 * 10/1996 Evans et al. ..... 427/446
5,973,588 * 10/1999 Cowman et al. ..... 338/21

* cited by examiner

*Primary Examiner*—Lincoln Donovan
*Assistant Examiner*—Kyung S. Lee
(74) *Attorney, Agent, or Firm*—Ostrolenk, Faber, Gerb & Soffen, LLP

(57) ABSTRACT

A monolithic varistor which is small and inexpensive and has excellent varistor characteristics includes a layered ceramic body containing ZnO as a primary component and, based on 100 mol % ZnO, an Al component in an amount of about 100–350 ppm calculated as $A1_2O_3$, a Bi component in an amount of about 1.0–3.0 mol % calculated as $Bi_2O_3$, a Co component in an amount of about 0.1–1.5 mol% calculated as $Co_2O_3$, an Mn component in an amount of about 0.1–1.0 mol % calculated as MnO, at least one Sb component and/or an Sn component in an amount of about 0.1–2.0 mol % calculated as $SbO_{3/2}$ or SnO, a Y component in an amount of 0-about 3.0 mol % calculated as $Y_2O_3$, an Si component in an amount of about 0.1–1.0 mol % calculated as $SiO_2$, and a B component in an amount of about 0.1–2.0 mol % calculated as $B_2O_3$; and an average grain size in a characteristic portion of the varistor is about 0.9–3.0 $\mu$m.

19 Claims, 12 Drawing Sheets

MONOLITHIC VARISTOR

BACKGROUND OF THE INVENTION

1. Field of the Invention

The present invention relates to a monolithic varistor, more particularly, to a monolithic varistor which comprises ZnO as a primary component and has a varistor voltage of 100 V or more. The present invention also relates to a ceramic for producing the varistor and to a method for producing the varistor. Throughout the specification, "varistor voltage" refers to voltage across the varistor measured at a current of 1 mA.

2. Background Art

In recent years, development of a chip-type element and employment of higher frequencies have progressed along with the trend of miniaturization of electronic devices and higher-speed circuit operation. In addition, such an element is required to have a reduced size, especially in terms of height, in order to increase the packaging density of a circuit. A non-linear resistor, i.e., varistor serving as a noise-absorbing element, is not an exception; a chip-type varistor which is formed of a ceramic predominantly comprising zinc oxide or strontium titanate has brought on the market. In contrast, a single-layer varistor having lead terminals or a varistor in which a single varistor layer is "molded-in" a resin or glass has been used as a varistor having a high varistor voltage such as a varistor for alternating current.

However, the conventionally employed single-layer varistor has a drawback that when the maximum peak current is desired to be increased, the electrode area must also be enlarged, thus failing to attain miniaturization of the varistor; whereas miniaturization of the varistor is possible only at the cost of maximum peak current. Thus, miniaturization of a varistor having a varistor voltage of 100 V or more has seen no progress. To cope with the dilemma, a monolithic ceramic varistor comprising a layered ceramic body in which a plurality of internal electrodes are formed is desirable. In this case, however, the varistor voltage per unit thickness thereof must be increased. To this end, the grain size of the ceramic must be reduced without lowering the maximum peak current per unit area.

SUMMARY OF THE INVENTION

In view of the foregoing, an object of the present invention is to provide a monolithic varistor which is small and inexpensive, and which has excellent varistor characteristics.

Another object of the present invention is to provide a ceramic for producing the varistor.

Another object of the present invention is to provide a varistor which predominantly comprises ZnO and has a high varistor voltage of 1000–2500 V/mm.

Still another object of the present invention is to provide a method for producing the varistor.

Accordingly, in a first aspect of the present invention, there is provided a monolithic varistor which includes a layered ceramic body having a plurality of internal electrodes within the product and which is monolithically sintered, wherein the layered ceramic body comprises ZnO as a primary component, and, based on 100 mol % ZnO, an Al component in an amount of about 100–350 ppm calculated as $Al_2O_3$, a Bi component in an amount of about 1.0–3.0 mol % calculated as $Bi_2O_3$, a Co component in an amount of about 0.1–1.5 mol % calculated as $Co_2O_3$, an Mn component in an amount of about 0.1–1.0 mol % calculated as MnO, at least one of an Sb component and an Sn component in an amount of about 0.1–2.0 mol % calculated as $SbO_{3/2}$ or SnO, a Y component in an amount of 0-about 3.0 mol % calculated as $Y_2O_3$, an Si component in an amount of about 0.1–1.0 mol % calculated as $SiO_2$, and a B component in an amount of about 0.1–2.0 mol % calculated as $B_2O_3$; and which has an average grain size of about 0.9–3.0 $\mu$m at least in a characteristic portion which exhibits the varistor characteristic and is sandwiched by internal electrodes.

In a second aspect of the present invention, there is provided a monolithic varistor which includes a layered ceramic body having a plurality of internal electrodes within the product and which is monolithically sintered, wherein the layered ceramic body comprises ZnO as a primary component, and, based on 100 mol % ZnO, an Al component in an amount of about 100–350 ppm calculated as $Al_2O_3$, a Bi component in an amount of about 1.0–3.0 mol % calculated as $Bi_2O_3$, a Co component in an amount of about 0.1–1.5 mol % calculated as $Co_2O_3$, an Mn component in an amount of about 0.1–1.0 mol % calculated as MnO, at least one of an Sb component and an Sn component in an amount of about 0.1–2.0 mol % calculated as $SbO_{3/2}$ or SnO, a Y component in an amount of 0-about 3.0 mol % calculated as $Y_2O_3$, an Si component in an amount of about 0.1–1.0 mol % calculated as $SiO_2$, and a B component in an amount of about 0.1–2.0 mol % calculated as $B_2O_3$; and which has a varistor voltage per unit thickness of about 1000–2500 V/mm when an electric current of 1 mA is applied.

In a third aspect of the present invention, there is provided a ceramic for a varistor which comprises ZnO as a primary component, and, based on 100 mol % of ZnO, an Al component in an amount of about 100–350 ppm calculated as $Al_2O_3$, a Bi component in an amount of about 1.0–3.0 mol % calculated as $Bi_2O_3$, a Co component in an amount of about 0.1–1.5 mol % calculated as $Co_2O_3$, an Mn component in an amount of about 0.1–1.0 mol % calculated as MnO, at least one of an Sb component and an Sn component in an amount of about 0.1–2.0 mol % calculated as $SbO_{3/2}$ or SnO, a Y component in an amount of 0-about 3.0 mol % calculated as $Y_2O_3$, an Si component in an amount of about 0.1–1.0 mol % calculated as $SiO_2$, and a B component in an amount of about 0.1–2.0 mol % calculated as $B_2O_3$.

In a fourth aspect of the present invention, there is provided a varistor which has a ceramic layer containing ZnO as a primary component and a plurality of internal electrodes in the ceramic layer, and which has a varistor voltage per unit thickness of 1000–2500 V/mm when an electric current of 1 mA is applied.

In a fifth aspect of the present invention, there is provided a method for producing a varistor which comprises the following steps:

- mixing starting raw materials including ZnO, and components of Al, Bi, Co, Mn, Y, Si, B, and at least one of Sb and Sn;
- calcining the resultant mixture;
- forming ceramic green sheets containing the calcined product;
- forming an internal electrode on each of the ceramic green sheets;
- laminating the green sheets;
- sintering the layered product; and
- providing on outer surfaces of the sintered product outer metallized portions which are connected to the internal electrodes.

Preferably, the starting raw materials in the method have the same composition as described in the first aspect of the invention.

The calcining temperature, the calcining time, the sintering temperature the sintering time, and the composition of the internal electrodes and the outer metallized portions are selected appropriately.

Preferably, the sintering step further includes a step for decomposing organic substances at about 600° C. for removal thereof.

BRIEF DESCRIPTION OF THE DRAWINGS

Various other objects, features, and many of the attendant advantages of the present invention will be readily appreciated as the same becomes better understood with reference to the following detailed description of the preferred embodiments in connection with the accompanying drawings, in which.

DESCRIPTION OF THE PREFERRED EMBODIMENTS

Figure 1:
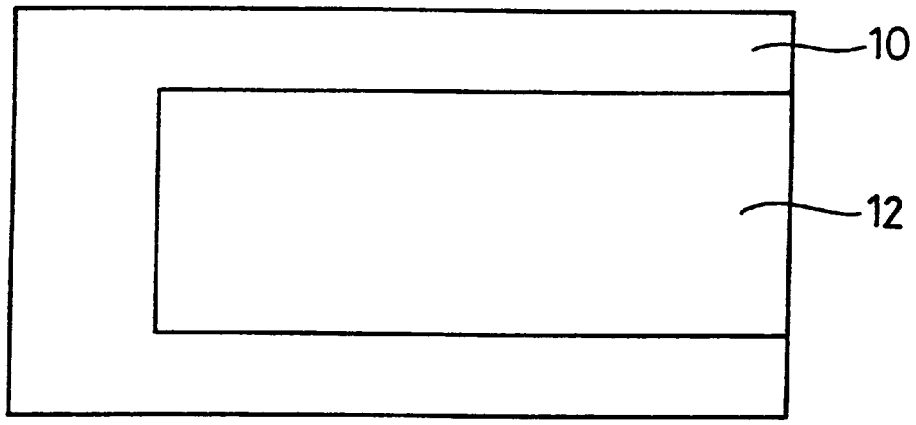
FIG. 1 is a top view of a pattern of Pt paste printed on a ceramic green sheet.

Effects provided by the additive components and the criteria for determining limitations on the amounts thereof will next be described.

$Al_2O_3$ lowers the clamping voltage and slightly elevates the varistor voltage. When $Al_2O_3$ content is about 100 ppm or more, the clamping voltage decreases, and as the amount of added $Al_2O_3$ increases, the clamping voltage is gradually stabilized. However, when $Al_2O_3$ content exceeds about 250 ppm, α begins to decrease. As described hereinlater, the value of α is determined from α=1/log(V10mA/V1mA) with the output voltage (V10mA) being measured when a current of 10 mA is applied between the Ag electrodes provided at opposite ends of the test piece. When α is 30 or more, the leakage current provides substantially no effect on a circuit. Therefore, the upper limit is determined as about 350 ppm where a becomes less than 30. The maximum peak current is more preferable when the $Al_2O_3$ content is about 200–300 ppm.

$B_2O_3$ serves to exhibit a varistor characteristic and enhances sinterability. When the $B_2O_3$ content is less than about 1.0 mol %, varistor voltage and a increase but sinterability is poor and maximum peak current decreases; whereas when it is in excess of about 3.0 mol %, maximum peak current decreases due to anomalous grain growth to lower homogeneity of the grains.

$Co_2O_3$ serves to increase the value of α. When the content is in excess of about 0.1 mol %, α is 30 or more. However, when it is in excess of about 1.5 mol %, $Co_2O_3$ is deposited in grain boundaries to thereby prevent grain growth and disadvantageously elevate varistor voltage and clamping voltage. In the case of $Co_2O_3$ and other additives, when clamping voltage ratio is in excess of 1.7, the maximum peak current decreases drastically. This phenomenon relates to the sinterability and heat generation of an element. Briefly, when sinterability is poor and both clamping voltage and varistor voltage are high, maximum peak current decreases. When varistor voltage per unit thickness is in excess of 2500 V/mm, the sinterability becomes poor and heat generation of the element increases to thereby reduce maximum peak current. When the content of $Co_2O_3$ is about 0.3–1 mol %, α and maximum peak current are more preferable.

MnO has the effect of increasing α as in the case of $Co_2O_3$. However, when the MnO content is about 0.1 mol % or less, the effect is insignificant, whereas when it is in excess of about 1.0 mol %, maximum peak current decreases and clamping voltage increases as in the case of $Co_2O_3$. When the MnO content is about 0.3–1 mol %, more preferable values are obtained for α and maximum peak current.

$Sb_2O_3$ and SnO have the effect of increasing varistor voltage and α. When the $Sb_2O_3$ and/or SnO content is about 0.1 mol %, α is 30 or more and varistor voltage increases; whereas when it is in excess of about 2.0 mol %, maximum peak current decreases. The Sb component and the Sn component may be used singly or in combination. When the $Sb_2O_3$ and/or SnO content is about 1–2 mol %, varistor voltage and α exhibit more preferable values.

$Y_2O_3$ increases a when added in a relatively small amount and varistor voltage when added in a relatively large amount. The addition of $Y_2O_3$ prevents variation of clamping voltage ratio and is effective for regulating varistor voltage. However, when the $Y_2O_3$ content is about 3.0 mol % or more, sintering is inhibited and maximum peak current decreases. When the $Y_2O_3$ content is about 1–3 mol %, varistor voltage exhibits more preferable values.

$SiO_2$ and $B_2O_3$ may be added singly or in the form of glass together with the Bi component or the Zn component. When $SiO_2$ and $B_2O_3$ are added in the form of glass, they lower sintering temperature due to formation of the liquid phase. When $SiO_2$ and/or $B_2O_3$ are added by way of $SiO_2$ alone or $B_2O_3$ alone, they lower sintering temperature and serve as sintering aids. Thus, $SiO_2$ and $B_2O_3$ individually have the effect of increasing α. However, when they are added in large amounts, anomalous grain growth occurs and crystals of zinc silicate or zinc borate are deposited to thereby cause drastic decrease and variation of varistor voltage. Therefore, $SiO_2$ content is limited to about 0.1–1 mol % and $B_2O_3$ content is limited to about 0.1–2.0 mol %. When $SiO_2$ content is about 0.1–0.3 mol % or $B_2O_3$ content is about 0.2–0.7 mol %, more preferable values are attained with respect to varistor voltage, maximum peak current and α.

The layered ceramic body described above is sintered at a firing temperature of 850–900° C. During sintering, grain growth is suppressed to thereby enhance varistor voltage per unit thickness. The average grain size of the characteristic portion of the layered ceramic body relates to clamping voltage. When average grain size is less than about 0.9 μm, clamping voltage disadvantageously increases due to, for example, poor sintering, whereas when it is about 3.0 μm or more, clamping voltage disadvantageously increases due to increase of grain boundary deposits formed from excessive additives or through over-proceeded reaction. Therefore, the average grain size of the characteristic portion of the layered ceramic body is preferably about 0.9–3.0 μm . As used herein, the characteristic portion refers to a portion which provides the varistor characteristic and is sandwiched by internal electrodes having a different polarity in the layered ceramic body.

In addition, varistor voltage per unit thickness is a factor which is important in designing an element and determines maximum peak current. When varistor voltage per unit thickness is excessively high, the element is adversely affected. Thus, varistor voltage has an upper limit. For example, when varistor voltage per unit thickness is in excess of 2500 V/mm, maximum peak current decreases due to, for example, poor sintering. When it is less than 1000 V/mm, there can be obtained varistor characteristics similar to those of a conventional product; because α is low and when varistor voltage is designed to be 100 V or more, a desired characteristic area cannot be obtained due to an increase in the thickness of a characteristic layer. Therefore, varistor voltage per unit thickness is preferably about 1000–2500 V/mm.

EXAMPLES

To 100 mol % of ZnO were added an Al component (0–500 ppm calculated as $Al_2O_3$), a Bi component (0.5–3.0 mol % calculated as $Bi_2O_3$), a Co component (0–3.0 mol % calculated as $Co_2O_3$), an Mn component (0–5.0 mol % calculated as MnO), at least one of an Sb component (0.1–5.0 mol % calculated as $SbO_{3/2}$) and an Sn component (0.1–5.0 mol % calculated as SnO), a Y component (0–5.0 mol % calculated as $Y_2O_3$), an Si component (0–5.0 mol % calculated as $SiO_2$), and a B component (0–5.0 mol % calculated as $B_2O_3$). The resultant mixture was mixed and pulverized for 60 hours by use of a ball mill. The mixture was then dehydrated and dried, and granulated by use of a #60 sieve. The resultant powder was calcined at 750° C. for two hours. The obtained calcined material was roughly pounded, followed by additional mixing and pulverization by use of a ball mill. The resultant slurry was dehydrated and dried to thereby obtain a powder.

To the powder were added a solvent, a binder and a dispersant, and the mixture was formed into a sheet having a thickness of 50 μm. The sheet was punched to a predetermined size to thereby obtain a plurality of ceramic green sheets 10. Pt paste 12 was applied, through screen printing, onto a portion of each green sheet 10 in a pattern, for example, as shown in FIG. 1. The patterns of the Pt paste 12 would later be fired to become internal electrodes 16 of a monolithic varistor. Further, the green sheets 10 were layered in predetermined arrangements and in a predetermined sequence to thereby obtain a laminate.

Figure 2:
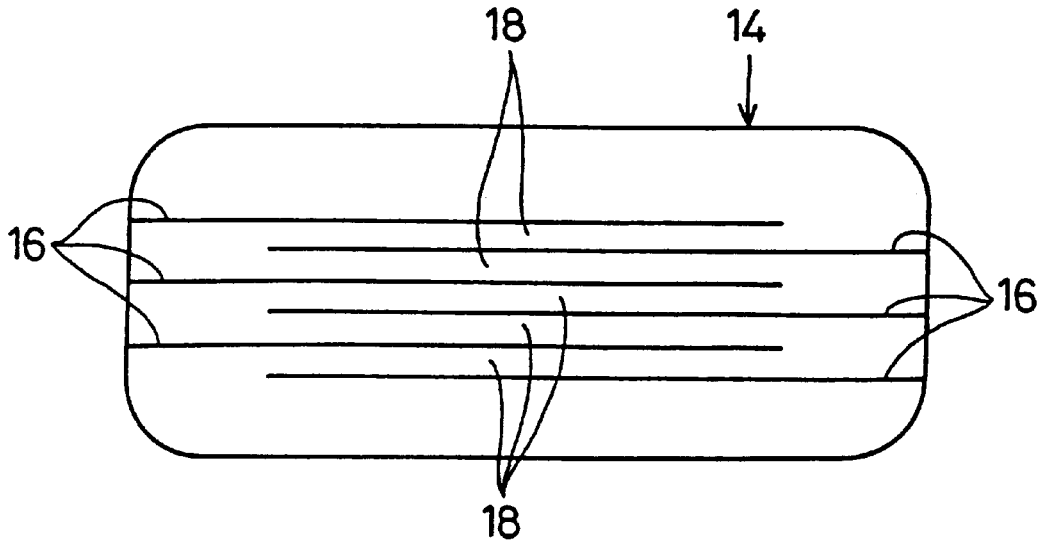
FIG. 2 is a schematic view showing an example of layering in a monolithic varistor of the present invention.
Figure 3:
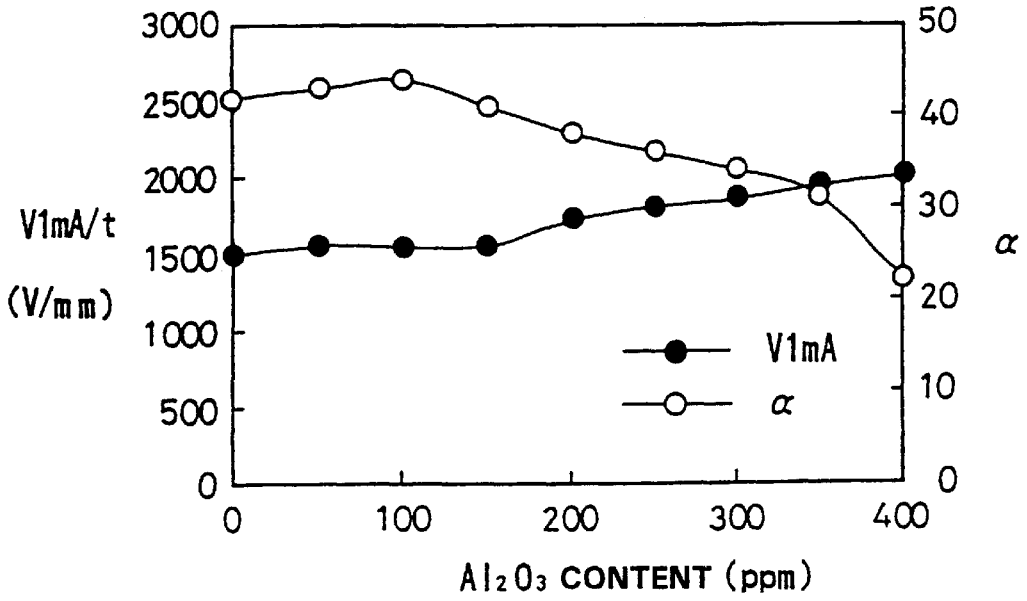
FIG. 3 is a graph showing the relationship between $Al_1O_3$ content and varistor voltage, and that between $Al_2O_3$ content and α.
Figure 4:
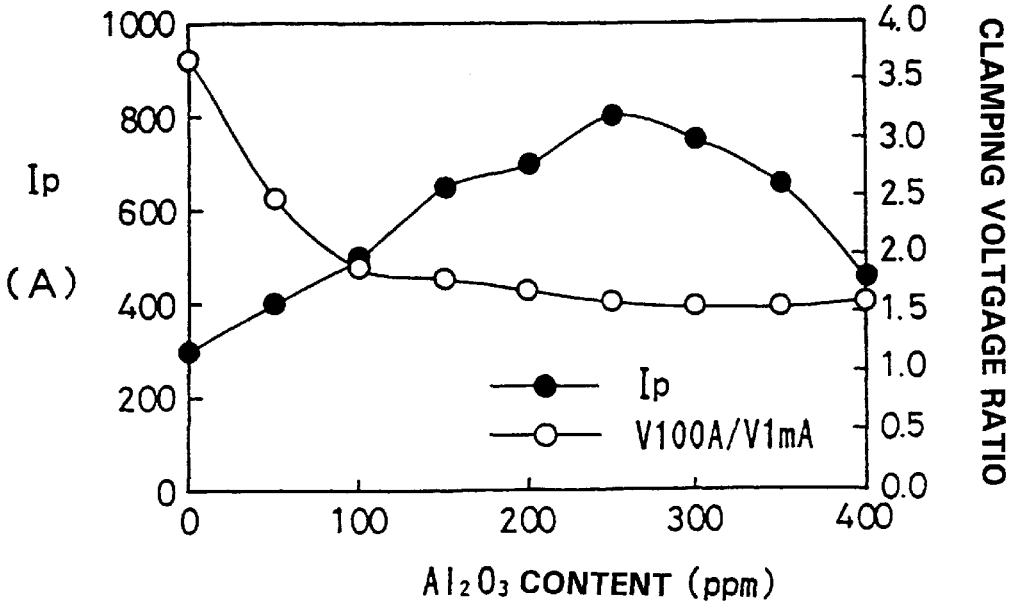
FIG. 4 is a graph showing the relationship between $Al_{12}O_3$ content and maximum peak current, and that between $Al_{12}O_3$ content and clamping voltage ratio.
Figure 5:
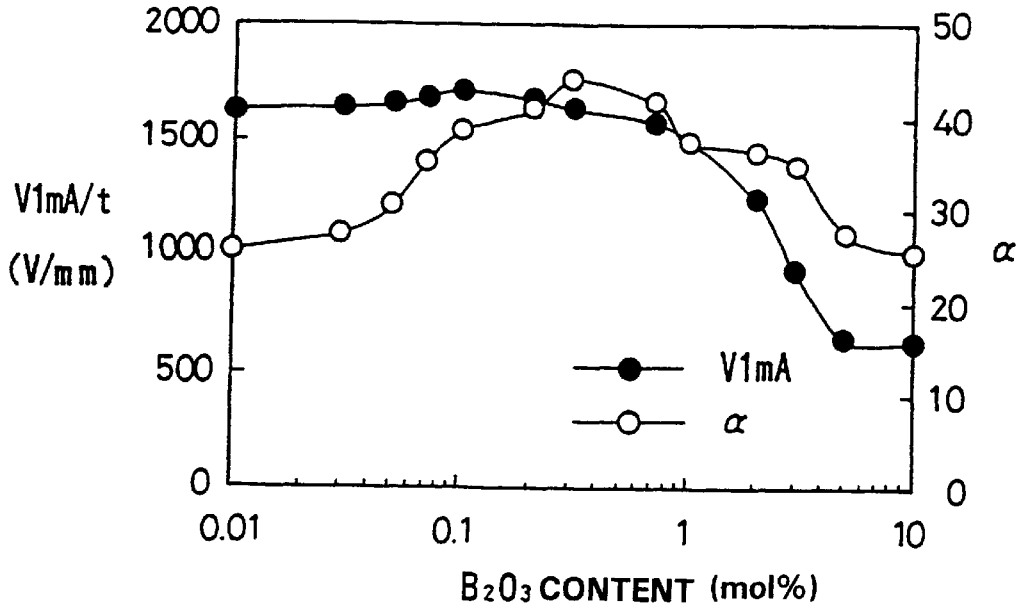
FIG. 5 is a graph showing the relationship between $B_2O_3$ content and varistor voltage, and that between $B_2O_3$ content and α.
Figure 6:
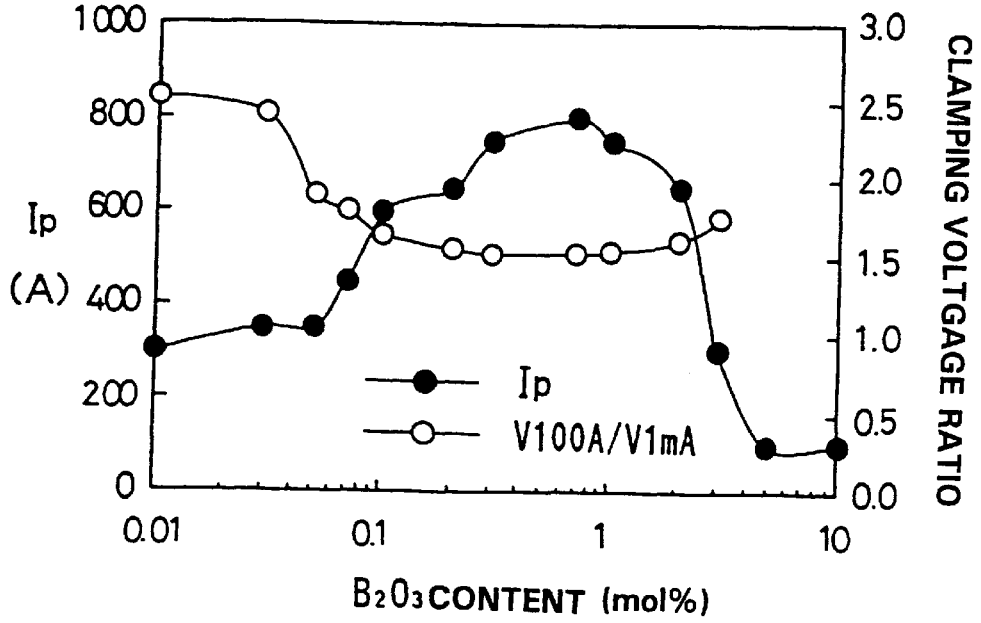
FIG. 6 is a graph showing the relationship between $B_2O_3$ content and maximum peak current, and that between $B_2O_3$ content and clamping voltage ratio.
Figure 7:
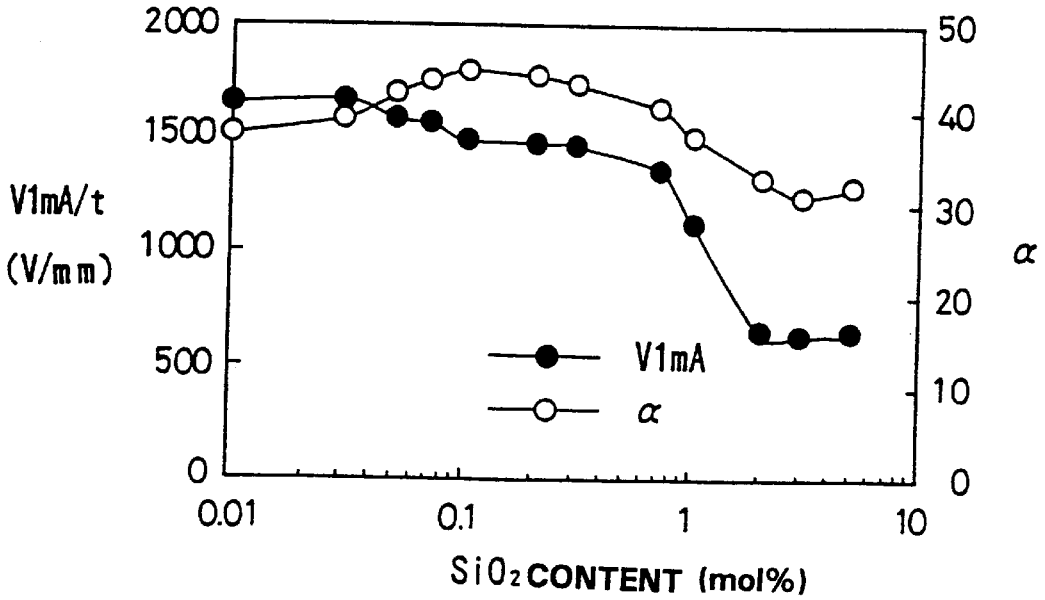
FIG. 7 is a graph showing the relationship between $SiO_2$ content and varistor voltage, and that between $SiO_2$ content and α.
Figure 8:
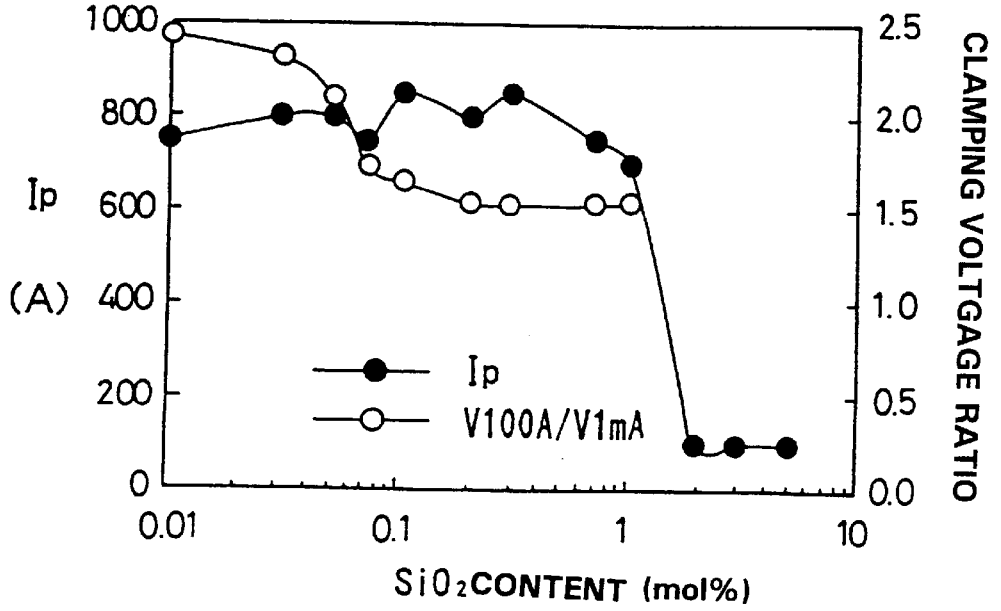
FIG. 8 is a graph showing the relationship between $SiO_2$ content and maximum peak current, and that between $SiO_2$ content and clamping voltage ratio.
Figure 9:
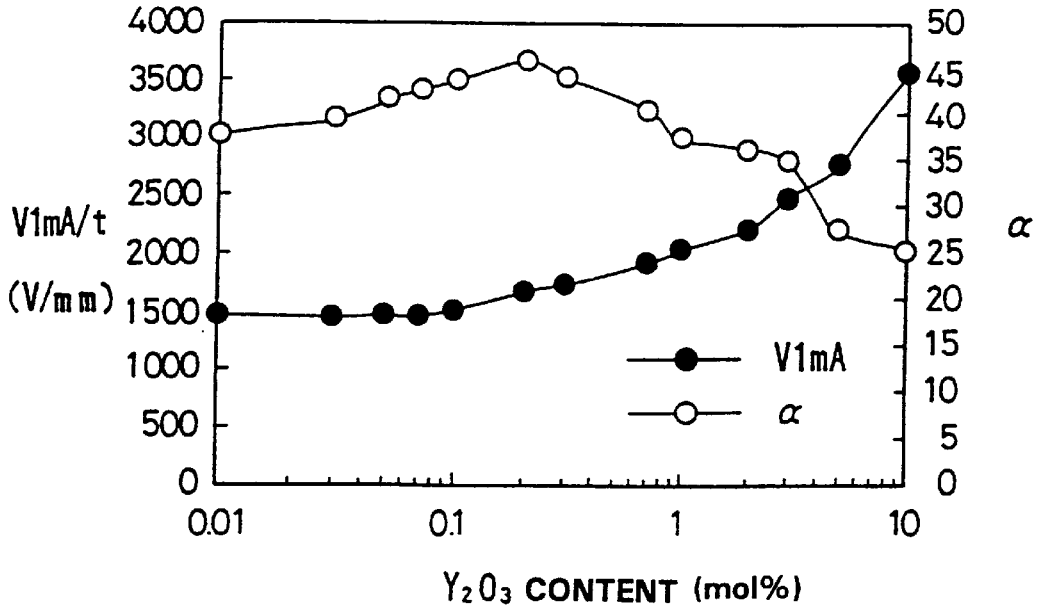
FIG. 9 is a graph showing the relationship between $Y_2O_3$ content and varistor voltage, and that between $Y_2O_3$ content and α.
Figure 10:
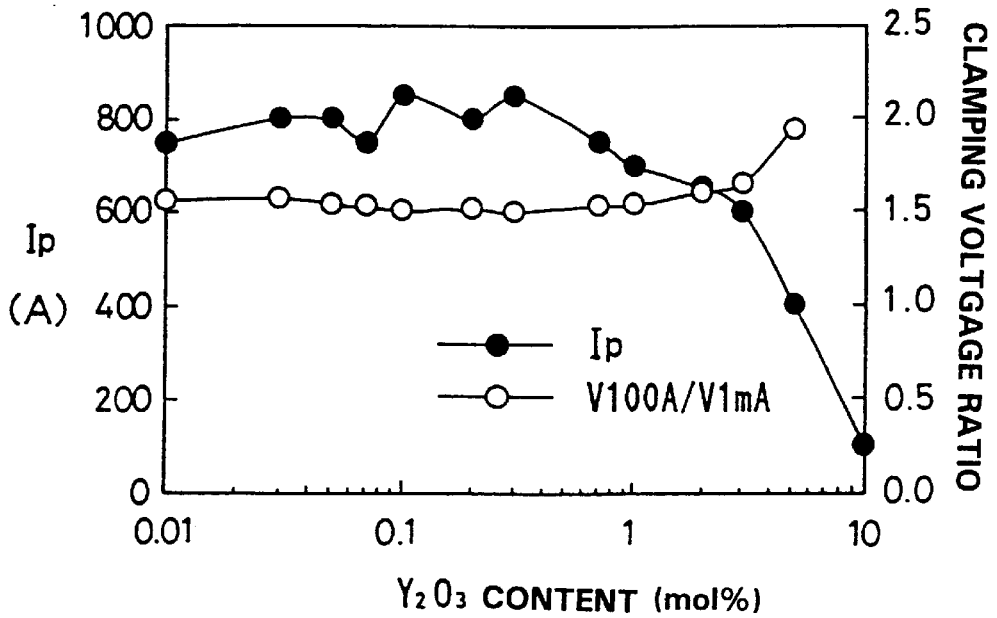
FIG. 10 is a graph showing the relationship between $Y_2O_3$ content and maximum peak current, and that between $Y_2O_3$ content and clamping voltage ratio.
Figure 11:
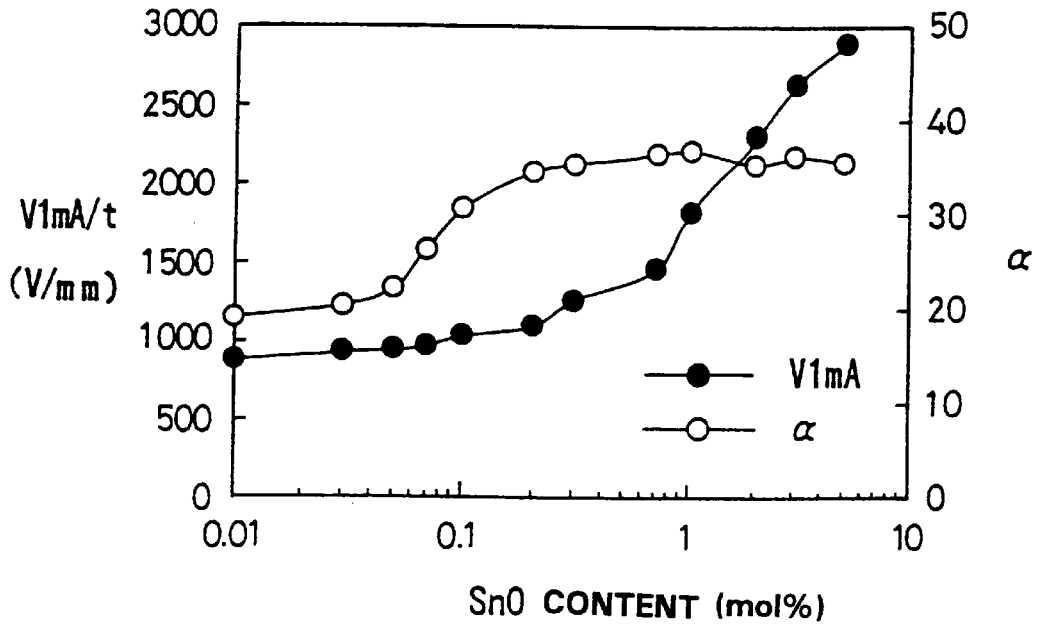
FIG. 11 is a graph showing the relationship between SnO content and varistor voltage, and that between SnO content and α.
Figure 12:
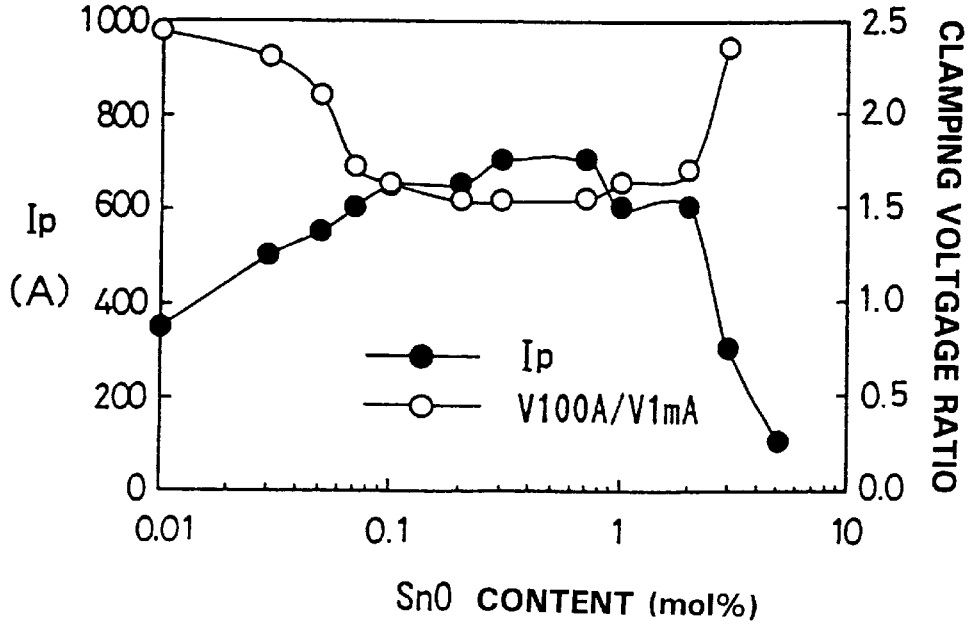
FIG. 12 is a graph showing the relationship between SnO content and maximum peak current, and that between SnO content and clamping voltage ratio.
Figure 13:
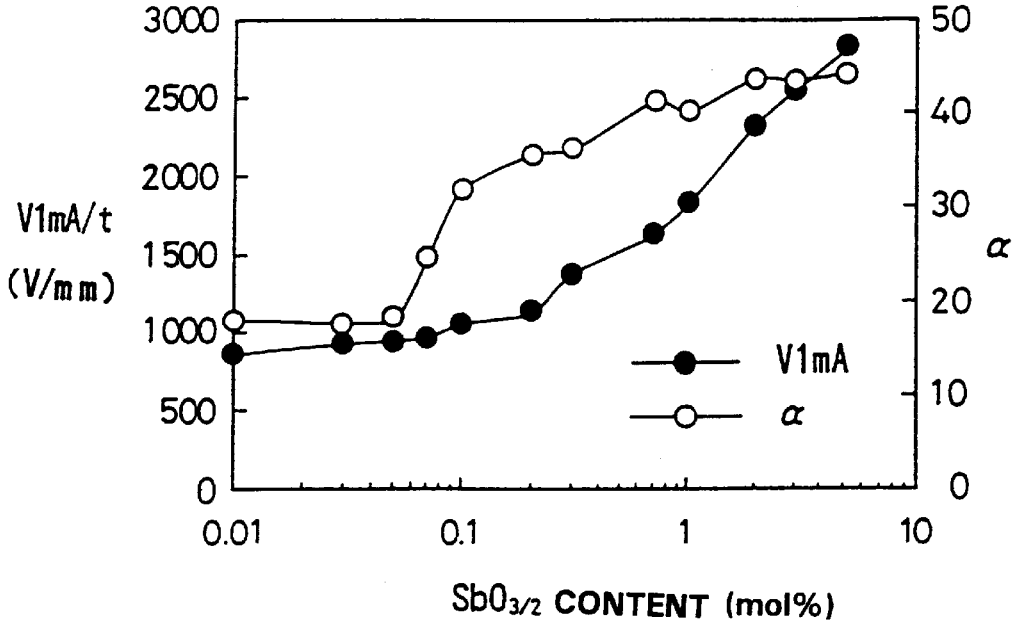
FIG. 13 is a graph showing the relationship between $SnO_{3/2}$ content and varistor voltage, and that between $SnO_{3/2}$ content and α.
Figure 14:
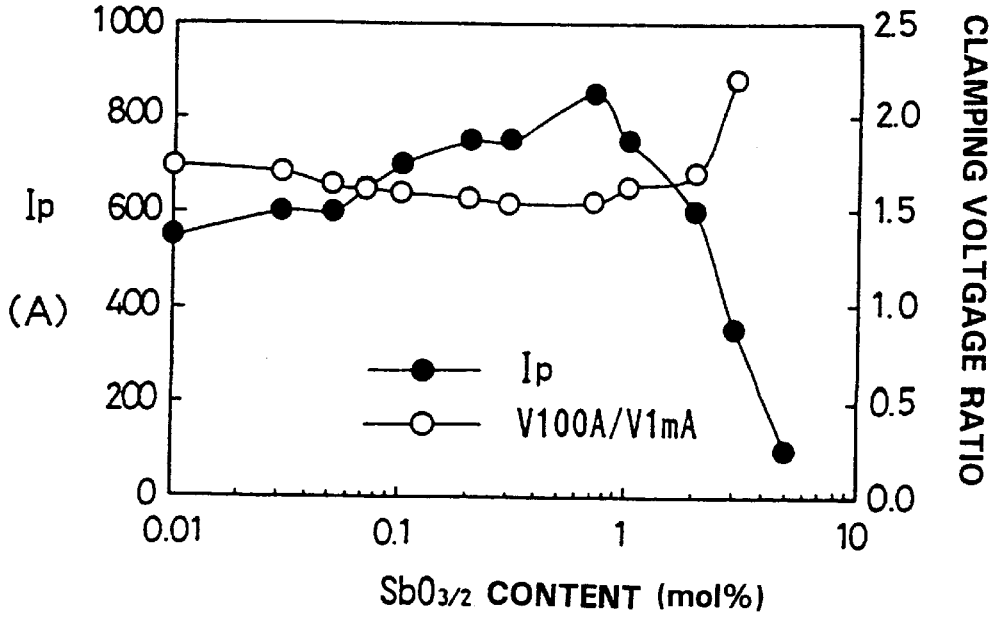
FIG. 14 is a graph showing the relationship between $SnO_{3/2}$ content and maximum peak current, and that between $SnO_{3/2}$ content and clamping voltage ratio.
Figure 15:
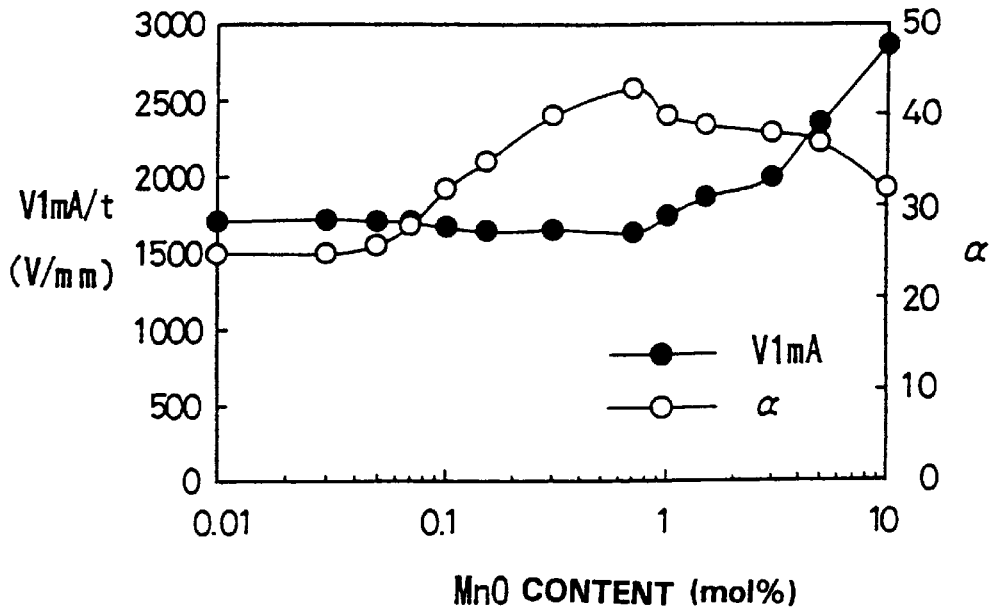
FIG. 15 is a graph showing the relationship between MnO content and varistor voltage, and that between MnO content and α.
Figure 16:
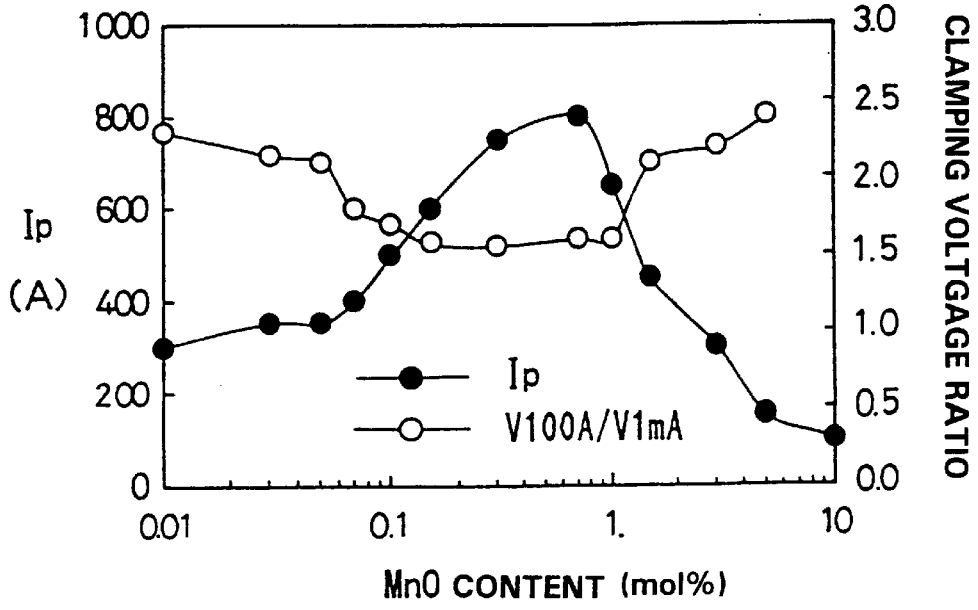
FIG. 16 is a graph showing the relationship between MnO content and maximum peak current and, that between MnO content and clamping voltage ratio.
Figure 17:
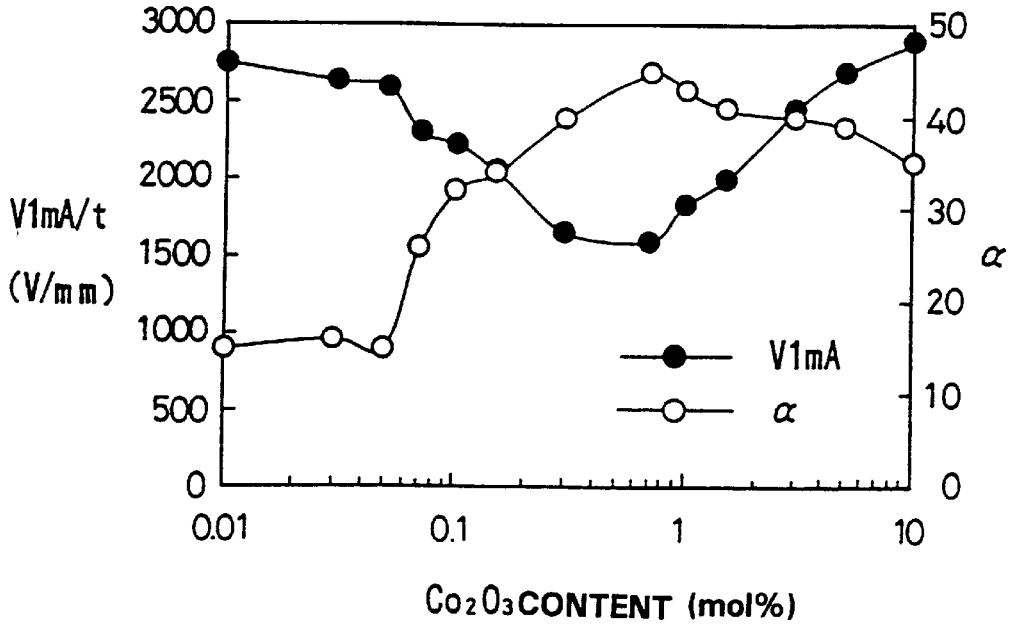
FIG. 17 is a graph showing the relationship between $Co_2O_3$ content and varistor voltage, and that between $Co_2O_3$ content and α.
Figure 18:
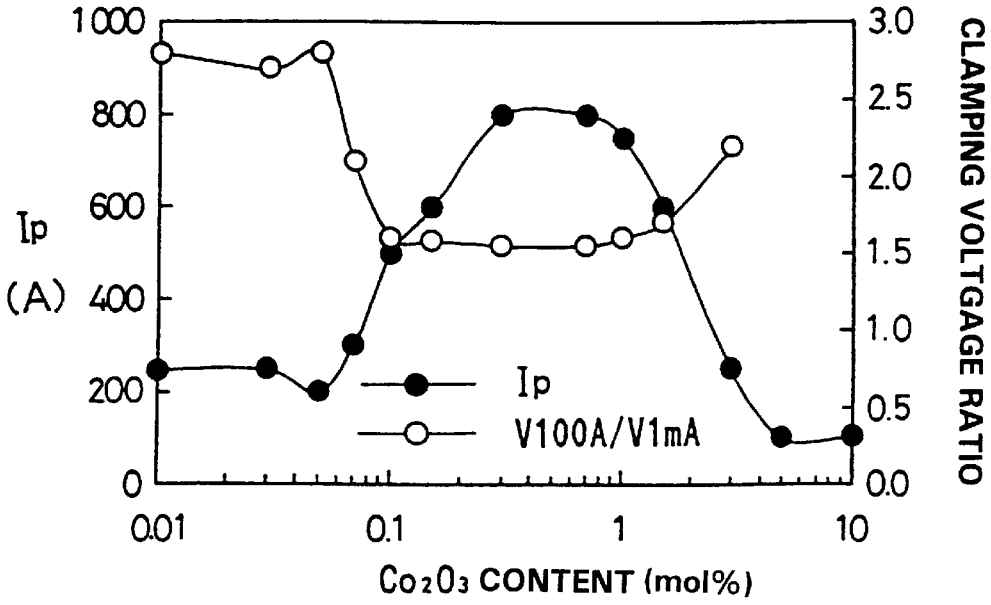
FIG. 18 is a graph showing the relationship between $Co_2O_3$ content and maximum peak current, and that between $Co_2O_3$ content and clamping voltage ratio.
Figure 19:
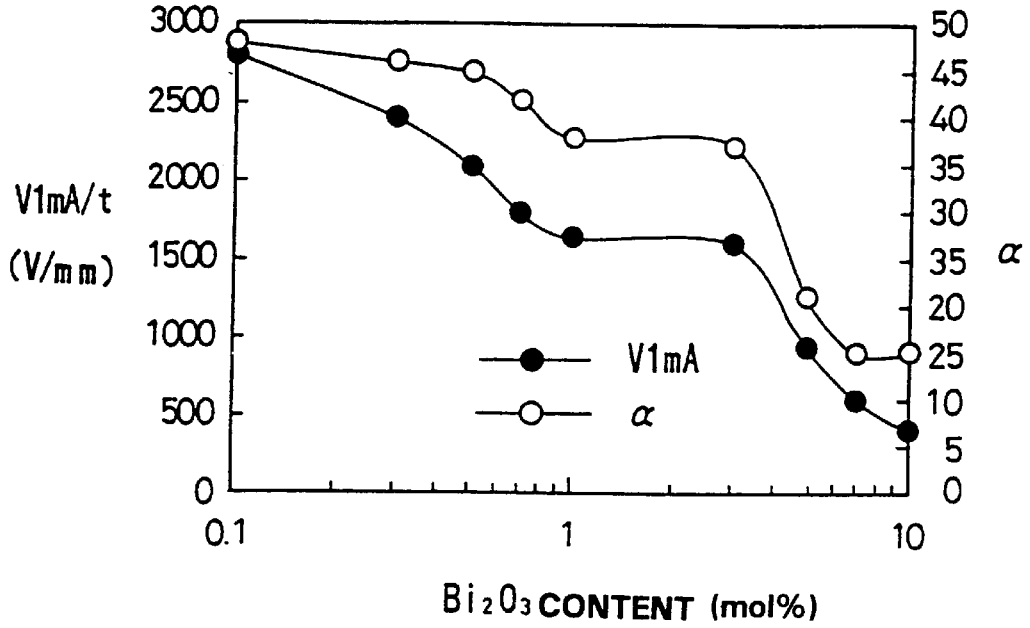
FIG. 19 is a graph showing the relationship between $Bi_2O_3$ content and varistor voltage, and that between $Bi_2O_3$ content and α.
Figure 20:
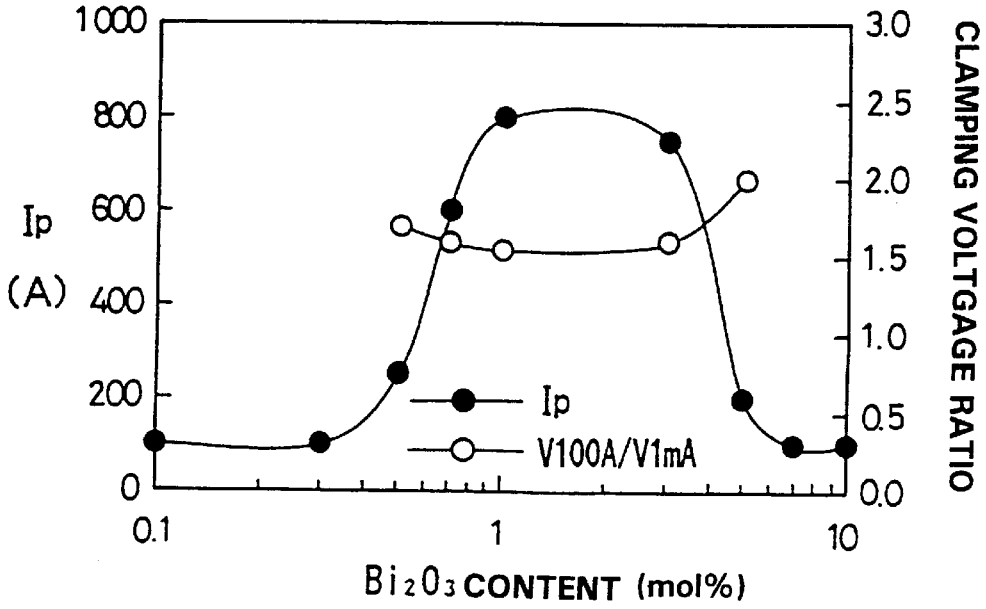
FIG. 20 is a graph showing the relationship between $Bi_2O_3$ content and maximum peak current, and that between $Bi_2O_3$ content and clamping voltage ratio.

The resin component was decomposed and released from the thus-obtained laminate at 600° C., and the laminate was fired and sintered at 850–900° C. for three hours to thereby obtain a layered ceramic body 14 as shown in FIG. 2. Ag paste for forming external electrodes was applied to the portions of the internal electrodes 16 exposed at both side surfaces of the layered ceramic body 14. The applied Ag serving as external electrodes was then burnt at 800° C. to thereby obtain a monolithic varistor according to the present embodiment.

The basic composition of the layered ceramic body according to the present embodiment is as follows: with respect to 100 mol % ZnO serving as the primary component; $Al_2O_3$: 250 ppm, $B_2O_3$: 1.5 mol %, $Co_2O_3$: 0.5 mol %, MnO: 0.5 mol %, $Sb_2O_3$: 0.3 mol %, $Y_2O_3$: 0 mol % $SiO_2$: 0.2 mol %, $B_2O_3$: 0.5 mol %. A monolithic varistor having the layered ceramic body 14 of this basic composition was prepared and subjected to the following evaluation tests.

Measurement of varistor voltage was performed by measuring an output voltage produced when a current of 1 mA was applied between the Ag electrodes provided at opposite ends of the test piece. This voltage is hereinafter represented by V1mA.

Maximum peak current was measured in a test in which a current having a standard waveform of 8×20 μsec was applied twice with a one minute interval between applications, and this procedure was repeated while the current as measured at its wavefront was increased stepwise from 100A in 50A increments. Maximum peak current (Ip(A)) is defined as the value of a wavefront of the current applied immediately before the final application of current that caused breakdown of the test piece.

The waveforms of current and voltage under application of a current of 100A were monitored through a storage oscilloscope. The ratio of the voltage under application of a current of 100A to the varistor voltage (V1mA) was represented by clamping voltage ratio (V100A/V1mA).

Further, in order to check the percentage variation of the corresponding varistor voltage (V1mA) after application of a surge current, a current having a standard waveform of 8×20 μsec was applied twice with a one minute interval between applications, and five minutes thereafter, the varistor voltage (V1mA) was measured to thereby investigate the variation (%) of the corresponding varistor voltage (VlmA).

The test results are shown in FIG. 1.

For comparison, Table 1 also shows the results of a similar test conducted for this embodiment and two single-layered molded-type chip varistors available on the market.

TABLE 1

| Sample | V1mA (V) | Maximum peak current (A) | Clamping voltage ratio | Variation (%) of V1mA after application of surge 300A | 400A | 500A | 600A | 700A | 800A |
|---|---|---|---|---|---|---|---|---|---|
| Example of this Invention | 275 | 800 | 1.54 | 0.5 | 0.7 | 1.5 | 2.4 | 3.6 | 4.5 |
| Comparative Example 1 (Conventional) | 271 | 650 | 4.20 | 0.7 | 1.5 | −1.0 | −8.7 | Breakdown | — |
| Comparative Example 2 (Conventional) | 283 | 800 | 3.15 | 0.6 | 1.2 | 2.4 | 1.1 | −3.2 | −8.7 |

The test results shows that, in contrast to the case of a conventional single-layer varistor, the monolithic varistor does not gradually degrade to reach breakdown due to surge current, but directly reaches breakdown at a certain value of surge current.

Next, monolithic varistors were prepared by changing the amount of each component of the standard composition, and subjected to tests. The test results are shown in FIGS. 3–20.Each of FIGS. 3, 5, 7, 9, 11, 13, 15, 17, and 19 is a graph showing the relationship between the content of a component (mol %) and varistor voltage (V1mA/t(V/mm)) per unit thickness measured at a portion (the characteristic portion 18) sandwiched between the internal electrodes 16 of the layered ceramic body, and the relationship between the content of the same component (mol %) and α. The value of α is determined from the equation: α=1/log(V10mA/V1mA) based on an output voltage (V10mA) measured when a current of 10 mA was applied between the Ag electrodes provided at opposite ends of the test piece.

Further, each of FIGS. 4, 6, 8, 10, 12, 14, 16, 18, and 20 is a graph showing the relationship between the content of a component (mol %) and maximum peak current (Ip(A)), and the relationship between the content of the same component (mol %) and clamping voltage ratio (V100A/V1mA).

Figure 21:
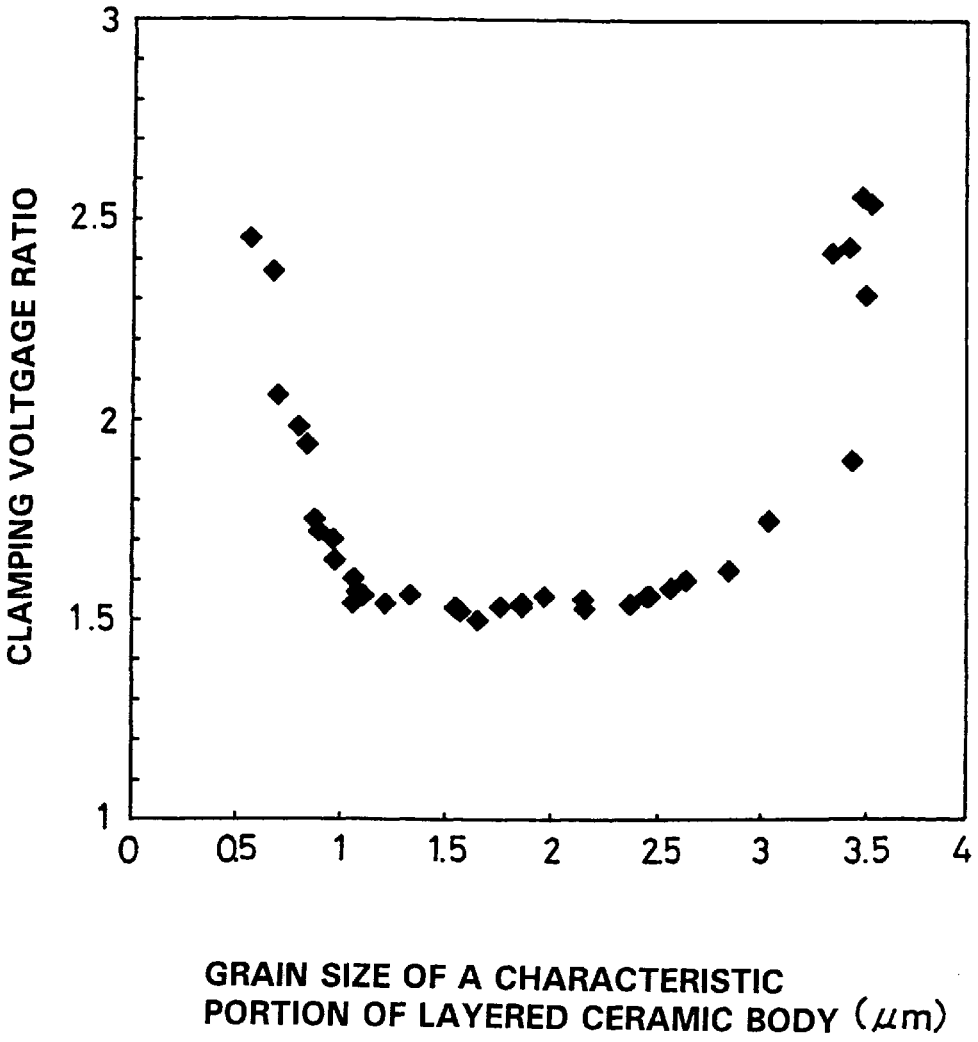
FIG. 21 is a graph showing the relationship between the grain size in the characteristic portion of a ceramic laminate and clamping voltage ratio.
Figure 22:
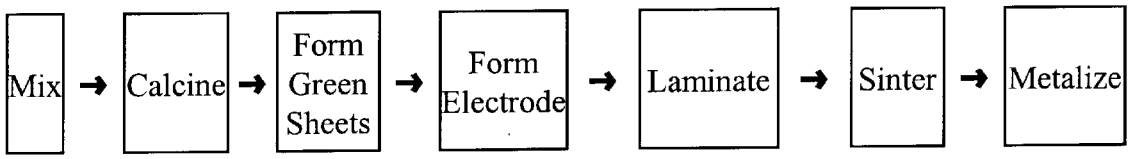
FIG. 22 is a flow chart of the method of production of the method of producing the varistor.

The cross-section of each of the monolithic varistors was polished, and then etched at 750° C. for five minutes. The grains contained in the characteristic portion 18 of the layered ceramic body 14 were observed under a SEM (scanning electron microscope) so as to measured the average grain size (μm). FIG. 21 shows the relationship between average grain size and clamping voltage ratio.

As is apparent from FIG. 21, if the average grain size in the characteristic portion 18 of the layered ceramic body 14 is less than about 0.9 μm, clamping voltage ratio increases due to insufficient sintering and like causes, whereas if the average grain size is about 3 μm or more, the clamping voltage ratio increases due to increase of grain boundary deposits formed from excessive additives or through overproceeded reaction.

As described above, the present invention provides a monolithic varistor which is small, inexpensive and has high performance in suppressing surge voltage. Specifically, the present invention provides, for example, a monolithic varistor chip having a varistor voltage of 100–500 V in an element of 4.5×3.2×2.0–2.5 (mm). The monolithic varistor chip has a performance equivalent to that of a conventional single-layered varistor having a chip size of 8.0×5.6×2.0 (mm). Further, the monolithic varistor chip exhibits improved performance in suppressing surge voltage, exhibiting a clamping voltage ratio of about ⅕that of a conventional single-layered varistor.

What is claimed is:

1. A monolithic varistor which comprises a monolithically sintered layered ceramic body having a plurality of internal electrodes, wherein the ceramic comprises ZnO and, based on 100 mol % ZnO, an Al component in an amount of about 100–350 ppm calculated as $Al_2O_3$, a Bi component in an amount of about 1.0–3.0 mol % calculated as $Bi_2O_3$, a Co component in an amount of about 0.1–1.5 mol % calculated as $Co_2O_3$, an Mn component in an amount of about 0.1–1.0 mol % calculated as MnO, at least one of an Sb component and an Sn component in an amount of about 0.1–2.0 mol % calculated as $SbO_{3/2}$ or SnO, a Y component in an amount of 0.0 about 3.0 mol % calculated as $Y_2O_3$, an Si component in an amount of about 0.1–1.0 mol % calculated as $SiO_2$, and a B component in an amount of about 0.1–2.0 mol % calculated as $B_2O_3$; and which has an average grain size of about 0.9–3.0 μm at least in a portion which exhibits a varistor characteristic and is sandwiched by internal electrodes.

2. A monolithic varistor which comprises a monolithically sintered layered ceramic body having a plurality of internal electrodes, wherein the ceramic comprises ZnO and, based on 100 mol % ZnO, an Al component in an amount of about 100–350 ppm calculated as $Al_2O_3$, a Bi component in an amount of about 1.0–3.0 mol % calculated as $Bi_2O_3$, a Co component in an amount of about 0.1–1.5 mol % calculated as $Co_2O_3$, an Mn component in an amount of about 0.1–1.0 mol % calculated as MnO, at least one of an Sb component and an Sn component in an amount of about 0.1–2.0 mol % calculated as $SbO_{3/2}$ or SnO, a Y component in an amount of 0.0 about 3.0 mol % calculated as $Y_2O_3$, an Si component in an amount of about 0.1–1.0 mol % calculated as $SiO_2$, and a B component in an amount of about 0.1–2.0 mol % calculated as $B_2O_3$; and which has a varistor voltage per unit thickness of about 1000–2500 V/mm when an electric current of 1 mA is applied.

3. A monolithic varistor according to claim 2, wherein the ceramic contains the Al component in an amount of about 200–300 ppm calculated as $Al_2O_3$; the Co component in an amount of about 0.3–1.0 mol % calculated as $Co_2O_3$; the Mn component in an amount of about 0.3–1.0 mol % calculated as MnO; the at least one of the Sb or Sn component in an amount of about 1.0–2.0 mol % calculated as $SbO_{3/2}$ or SnO; the Y component in an amount of about 1–3.0 mol % calculated as $Y_2O_3$; the Si component in an amount of about 0.1–0.3 mol % calculated as $SiO_2$; the B component in an amount of about 0.2–0.7 mol % calculated as $B_2O_3$; and which has an average grain size of about 0.9–3.0 μm at least a portion exhibiting varistor characteristics and sandwiched by internal electrodes.

4. A ceramic for a varistor which comprises ZnO and, based on 100 mol % of ZnO, an Al component in an amount of about 100–350 ppm calculated as $Al_2O_3$, a Bi component in an amount of about 1.0–3.0 mol % calculated as $Bi_2O_3$, a Co component in an amount of about 0.1–1.5 mol % calculated as $Co_2O_3$, an Mn component in an amount of about 0.1–1.0 mol % calculated as MnO, at least one of an Sb component and an Sn component in an amount of about 0.1–2.0 mol % calculated as $SbO_{3/2}$ or SnO, a Y component in an amount of 0.0 about 3.0 mol % calculated as $Y_2O_3$, an Si component in an amount of about 0.1–1.0 mol % calculated as $Si_2$, and a B component in an amount of about 0.1–2.0 mol % calculated as $B_2O_3$.

5. A ceramic for a varistor according to claim 4, wherein the Al component is in an amount of about 200–300 ppm calculated as $Al_2O_3$.

6. A ceramic for a varistor according to claim 4, wherein the Co component is in an amount of about 0.3–1.0 mol % calculated as $Co_2O_3$.

7. A ceramic for a varistor according to claim 4, wherein the Mn component is in an amount of about 0.3–1.0 mol % calculated as Mno.

8. A ceramic for a varistor according to claim 4, wherein the at least one of the Sb or Sn component is in an amount of about 1.0–2.0 mol % calculated as $SbO_{3/2}$ or SnO.

9. A ceramic for a varistor according to claim 4, wherein the Y component is in an amount of about 1–3.0 mol % calculated as $Y_2O_3$.

10. A ceramic for a varistor according to claim 4, wherein the Si component is in an amount of about 0.1–0.3 mol % calculated as $SiO_2$.

11. A ceramic for a varistor according to claim 4, wherein the B component is in an amount of about 0.2–0.7 mol % calculated as $B_2O_3$.

12. A ceramic for a varistor according to claim 4, at least a portion of which has an average grain size of about 0.9–3.0 μm .

13. A ceramic for a varistor according to claim 12, wherein the Al component is in an amount of about 200–300 ppm calculated as $Al_2O_3$; the Co component is in an amount of about 0.3–1.0 mol % calculated as $Co_2O_3$; the Mn component is in an amount of about 0.3–1.0 mol % calculated as MnO; the at least one of the Sb or Sn component is in an amount of about 1.0–2.0 mol % calculated as $SbO_{3/2}$ or SnO; the Y component is in an amount of about 1–3.0 mol % calculated as $Y_2O_3$; the Si component is in an amount of about 0.1–0.3 mol % calculated as $SiO_2$; and the B component is in an amount of about 0.2–0.7 mol % calculated as $B_2O_3$.

14. A method for producing a varistor which comprises the following steps:

mixing starting raw materials including ZnO, and a source of Al, Bi, Co, Mn, Y, Si, B and at least one of Sb and Sn;

calcining the resultant mixture;

forming ceramic green sheets containing the calcined product;

forming an electrode on at least two of the ceramic green sheets;

forming a laminate including the two green sheets with electrodes such that the electrodes are in the interior thereof and separated from one another;

sintering the layered product; and providing on outer surfaces of the sintered product metallized portions which are electrically connected to the internal electrodes.

15. A method for producing a varistor according to claim 14, wherein the starting raw materials comprise Zno and, based on 100 mol % ZnO, an Al source in an amount of about 100–350 ppm calculated as $Al_2O_3$, a Bi source in an amount of about 1.0–3.0 mol % calculated as $Bi_2O_3$, a Co source in an amount of about 0.1–1.5 mol % calculated as $Co_2O_3$, an Mn source in an amount of about 0.1–1.0 mol % calculated as MnO, at least one of an Sb source and an Sn source in an amount of about 0.1–2.0 mol % calculated as $SbO_{3/2}$ or SnO, a Y source in an amount of 0.0 about 3.0 mol % calculated as $Y_2O_3$, an Si source in an amount of about 0.1–1.0 mol % calculated as $SiO_2$, and a B source in an amount of about 0.1–2.0 mol % calculated as $B_2O_3$.

16. A method for producing a varistor according to claim 14, wherein the starting raw materials comprise ZnO and, based on 100 mol % ZnO, an Al source in an amount of about 100–300 ppm calculated as $Al_2O_3$, a Bi source in an amount of about 1.0–3.0 mol % calculated as $Bi_2O_3$, a Co source in an amount of about 0.3–1 mol % calculated as $Co_2O_3$, an Mn source in an amount of about 0.3–1.0 mol % calculated as MnO, at least one of an Sb source and an Sn source in an amount of about 1–2 mol % calculated as $SbO_{3/2}$ or SnO, a Y source in an amount of about 1–3.0 mol % calculated as $Y_2O_3$, an Si source in an amount of about 0.1–0.3 mol % calculated as $SiO_2$, and a B source in an amount of about 0.2–0.7 mol % calculated as $B_2O_3$.

17. A method for producing a varistor according to claim 15, wherein the electrodes and external metallized portions comprise Pt.

18. A method for producing a varistor according to claim 15, wherein the calcining step is performed at about 750° C. for about two hours, and the firing step is performed at about 880–900° C. for about three hours.

19. A method for producing a varistor according to claim 18, wherein the sintering step further includes heating at about 600° C. to decompose and remove organic substances present.

* * * * *